US005319408A

United States Patent [19]

Shiota

[11] Patent Number: 5,319,408

[45] Date of Patent: Jun. 7, 1994

[54] METHOD AND APPARATUS FOR MAINTAINING PROCESSING PERFORMANCE IN AUTOMATIC DEVELOPING AND PRINTING SYSTEM

[75] Inventor: Kazuo Shiota, Kanagawa, Japan

[73] Assignee: Fuji Photo Film Co., Ltd., Kanagawa, Japan

[21] Appl. No.: 996,601

[22] Filed: Dec. 24, 1992

[30] Foreign Application Priority Data

Dec. 26, 1991 [JP] Japan ..... 3-356722

[51] Int. Cl.[5] ..... G03D 13/00; G03D 3/02

[52] U.S. Cl. ..... 354/298; 354/324; 354/334

[58] Field of Search ..... 354/298, 299, 324, 318, 354/319, 320, 321

[56] References Cited

U.S. PATENT DOCUMENTS 3,995,959 12/1976 Shaber ..... 354/298

4,293,211 10/1981 Kaufmann ..... 354/298

4,885,705 12/1989 Choi ..... 354/321 X

*Primary Examiner*—D. Rutledge

*Attorney, Agent, or Firm*—Sughrue, Mion, Zinn, Macpeak & Seas

[57] ABSTRACT

A method and apparatus for maintaining the developing performance of an automatic developing and printing system which develops a photographic film exposed, and automatically makes a print from the developed film by using a photographic paper. A photosensitive material is employed on which the pattern having portions different in the quantity of light has been formed by exposure and by development. This photosensitive material functions in the same way the photographic material having the control strips. Hence, the processing performance of the apparatus can be determined without use of the photographic material having the control strips which is expensive and troublesome to handle.

7 Claims, 4 Drawing Sheets

METHOD AND APPARATUS FOR MAINTAINING PROCESSING PERFORMANCE IN AUTOMATIC DEVELOPING AND PRINTING SYSTEM

BACKGROUND OF THE INVENTION

1. Field of the Invention

This invention relates to a method and apparatus in which the processing performance of a photosensitive material developing is detected, and necessary control is carried out for maintaining the performance within an allowable condition, and an apparatus for practicing the method. More particularly, the invention relates to a method and apparatus for maintaining the developing performance of an automatic developing and printing system which develops a photographic film exposed, and automatically makes a print from the developed film by using a photographic paper.

2. Description of the Related Art

An apparatus is well known in the art in which an exposed photographic film is developed by immersing it in a processing solution, and the film thus developed is automatically subjected to a printing processing to make a print thereof from the film thus developed. An example of the apparatus of this type is disclosed by Published Unexamined Japanese Patent Application No. Sho-64-15741.

The apparatus thus disclosed operates as follows. First, a film cartridge (patrone) accommodating a photographic film which has been exposed but not developed yet, is loaded in the apparatus. Under this condition, the apparatus is started. The apparatus automatically develops the film, and then exposes a photographic paper through the film thus developed. Upon the exposure, the apparatus develops the photographic paper thus exposed, to make a print.

The above-described automatic developing and printing apparatus which develops a photographic film, and make a print from it, has been generally installed at camera stores so as to be effectively used to develop photographic materials to provide prints quickly.

In the above-described automatic developing and printing apparatus including the photographic film developing unit and the printing unit (i.e., a color photographic paper developing unit), the developing performance is controlled separately for the film developing unit and for the photographic paper developing unit so that changes in developing performance are detected and corrected. These changes result from the condensation of the processing solution which is due to the change in temperature of the processing solution or evaporation of the latter, and changes in density of the processing solution which is due to fluctuation in the quantity of supplement solution thereto.

In general, the developing unit and the printing unit are controlled as follows. A photographic film or paper on which control strips (a pattern corresponding to LD, HD, $D_{max}$, and $D_{min}$) have been formed by exposure and which has not been developed yet, is processed with the developing unit and the printing unit whereas a print is made from an eyeball negative film (a film on which an eyeball-shaped gray pattern has been formed by exposure), thereby to measure the density thereof, so that the conditions of the developing unit and those of printing unit are controlled separately.

Recently, a method has been employed in which an ND filter is built in the light source section of a printing unit, and a densitometer is arranged at the paper discharging outlet thereof, so that operations corresponding to the exposure and print of the eyeball-shaped pattern and the measurement of density thereof are automatically carried out.

Published Examined Japanese Patent Application No. Hei. 3-69094 discloses an example of the processing-performance controlling method, in which the condition of a developing solution is detected by using the control strips thereby to control the amount of supplement solution thereto. On the other hand, Published Unexamined Japanese Patent Application No. Hei. 2-162348 discloses a method in which reference data are provided for each of the factors that adversely affect the processing operation, and the condition of the current processing operation is determined by using the control strips, and the results of determination are compared with the reference data to discover what factor adversely affects the processing operation.

However, a photographic material with the control strips is expensive. Furthermore, in order to prevent the change with time of the photographic material, it is necessary to store the photographic material in a refrigerator. Therefore, it is necessary to restore the temperature of the photographic material to room temperature before it is used. Thus, use of the photographic material with the control strips is rather troublesome, and not economical.

On the other hand, the overall finish of a print depends on the accumulation of errors in both the developing unit and the printing unit. Therefore, it is necessary to control the process to eliminate changes in the overall finish, which are caused by individual errors in the developing or printing unit or by the synergism of those individual changes. This control can be made only by a person skilled in the art.

On the other hand, when, in the apparatus, one condition changes to adversely affect the operation of the apparatus, sometimes the adverse effect may be eliminated by a change in another condition. In this case, correction of the conditions is unnecessary; however, it is difficult to determine that the correction is unnecessary.

Furthermore, the overall finish of a print is determined by the synergetic effect of the performance of the photographic film developing section, the performance of the printing optical system, and the performance of the photographic paper developing section. For instance, a print gradation reproducing characteristic with respect to an object depends on the synergetic effect of photographic film developing contrast performance and photographic paper developing contrast performance. On the other hand, as for a particular object, the printing density depends on the synergetic effect of film developing LD and HD performance, the photometric exposure performance of the printing optical system, and photographic paper developing LD and HD performance. Hence, even if the photographic film developing performance and the photographic paper developing performance are mutually shifted to an extent, the overall finish of the print depends on whether the synergetic effect of them acts to increase the error or whether it acts to decrease it.

Hence, in order to control the photographic film developing performance and the photographic paper developing performance separately, those performances must be controlled excessively strictly for the aimed overall finish. That is, the frequency of maintenance operations, such as replacement of the mother liquor, is increased remarkably. On the other hand, it can be made only by the person skilled in the art whether or not the developing performance is controlled for the aimed overall finish. This is another problem to be solved.

SUMMARY OF THE INVENTION

In view of the above, an object of the present invention is to provide a method and apparatus for maintaining the processing performance in an automatic developing and printing system, in which the developing performance can be easily maintained in a good condition without the use of control stripes and further total performance in both developing photographic films and photographic papers can be maintained with maintaining processing frequency as low as possible.

The foregoing object of the invention has been achieved by the provision of the following methods and apparatus:

(1) An apparatus for maintaining processing performance in an automatic developing and printing system comprising:

means for developing, under a predetermined condition, a reference negative film having at least three densities which respectively give a maximum density ($D_{max}$), a high density (HD), and a low density (LD) to a positive photosensitive material, so as to measure the densities of the positive photosensitive material thus developed;

means for obtaining a moving average of each of $D_{max}$, (HD−LD) and LD from the values $D_{max}$, HD and LD thus measured to obtain cumulative values thereof;

means for deciding that, when an amount of shift of each cumulative value from a reference value is equal to or more than a predetermined value, the value is in an increase tendency or in a decrease tendency;

means for identifying patterns which are combinations of results of decision of the cumulative values; and means for controlling a quantity of supplement to a developing solution according to the identification; and (2) A method of maintaining processing performance of a developing means for developing a photosensitive material, comprising the steps of:

exposing a pattern having portions different in the quantity of light on a photosensitive material;

developing the pattern on the photosensitive material;

measuring densities of the pattern thus formed;

comparing the densities thus measured with predetermined values to obtain variation pattern therefrom, comparing the variation pattern with predetermined reference variation patterns to determine the condition of developing performance of the developing means; and taking a suitable action automatically to maintain the developing performance the developing means.

The method and apparatus of the invention employs the photosensitive material on which the pattern having portions different in the quantity of light is formed by exposure and development. This photosensitive material functions in the same way as the photographic material having the control strips. Hence, the processing performance of the apparatus can be readily detected without use of the photographic material having the control strips which is expensive and troublesome to handle.

Furthermore, in the invention, when a plurality of detection densities, which are originally equal, are detected as different values, it is determined which condition from which part of the apparatus has changed, and the results of this determination are displayed, which allows the operator to detect changes in the processing conditions with ease. Hence, even a person not skilled in the art can readily determine how to correct the changes in the processing conditions.

In addition, when a plurality of operating conditions are changed, it can be readily detected whether or not the changes act to decrease their effects or whether they act to increase them. In the case where the changes are such that the effects thereof are canceled, the changes may be allowed; that is, they may be left as they are. Therefore, the frequency of troublesome maintenance operations such as replacement of the mother liquor is decreased as much.

In the invention, the photographic film and the photographic paper may be negative ones or positive ones if they are silver salt photosensitive materials, or they may be of transmission type or reflection type.

Furthermore, not only a photosensitive material of wet developing type, but also a photosensitive material of thermal developing type may be employed. In the case of the photosensitive material of thermal developing type, a change in solution density cannot be dealt with; however, the developing performance can be maintained by controlling the developing temperature.

BRIEF DESCRIPTION OF THE DRAWINGS

The accompanying drawings, which are incorporated in and constitute a part of the specification, illustrated presently preferred embodiments of the invention and, together with the general description given above and the detailed description of the preferred embodiments given below, serve to explain the principles of the invention. In the accompanying drawings.

DESCRIPTION OF THE PREFERRED EMBODIMENTS

One preferred embodiment of this invention will be described with reference to the accompanying drawings. However, it should be noted that the invention is not limited thereto or thereby; that is, it is obvious to those skilled in the art that various changes and modification may be made therein without departing from the technical concept of the invention.

Figure 1:
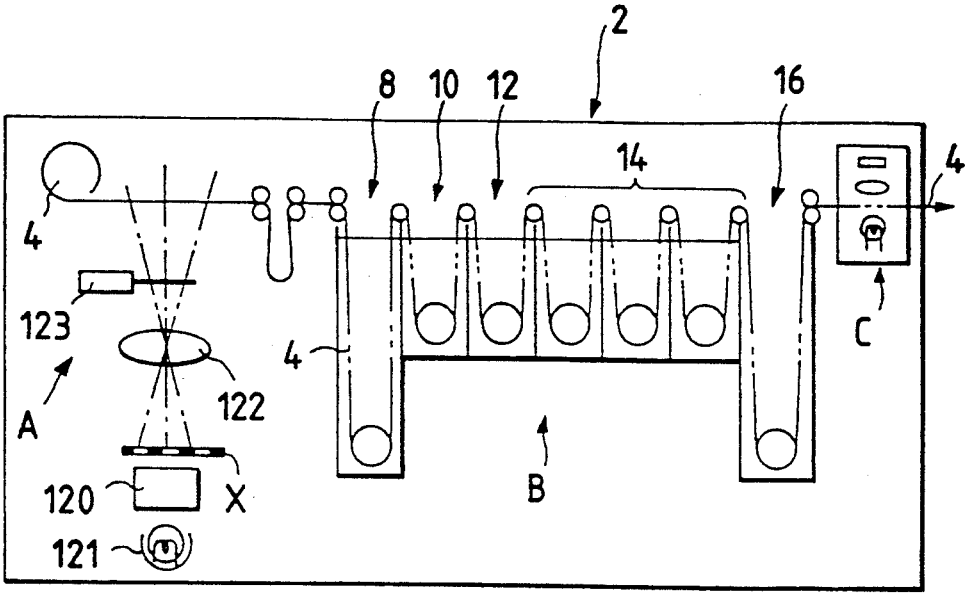
FIG. 1 is an explanatory diagram showing the arrangement of a photographic film developing unit.
Figure 2:
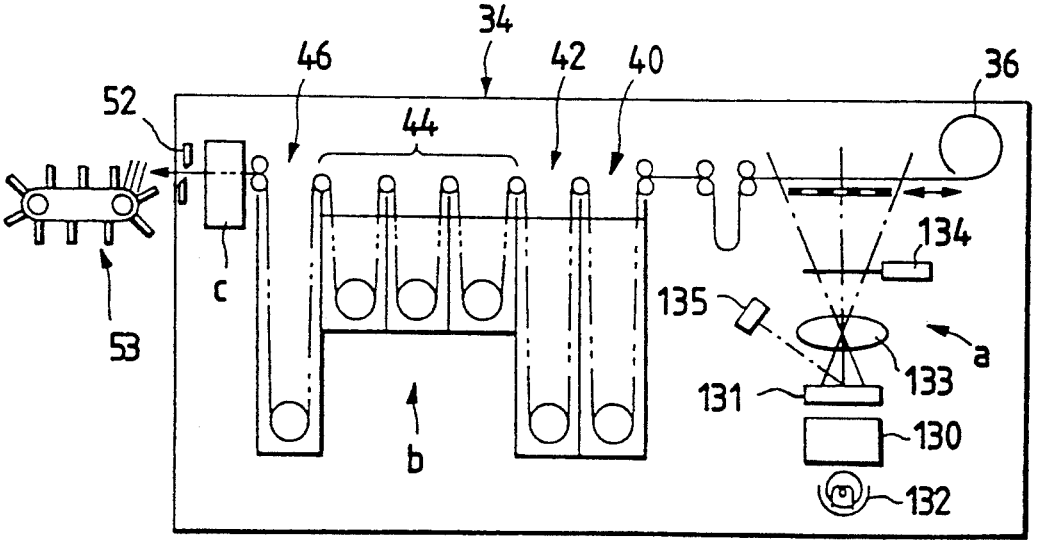
FIG. 2 is an explanatory diagram showing the arrangement of a printing unit.

FIGS. 1 and 2 are two parts of a diagram showing an automatic developing and printing apparatus 1 which practices a condition-detecting method according to the invention. More specifically, FIG. 1 is a diagram showing the arrangement of a developing unit 2 which is adapted to automatically develop a color negative film which has been exposed, and FIG. 2 is a diagram showing the arrangement of a printing unit 34. The printing unit 34 shown in FIG. 2 is provided behind the developing unit 2; that is, those units 34 and 2 are combined, thus forming the automatic developing and printing apparatus 1.

The arrangement of the developing unit 2, which is adapted to develop a negative film in a wet process mode, will be described with reference to FIG. 1. Roughly stated, the developing unit 2 comprises: a reference pattern forming section A which forms a reference pattern on a color negative film 4 by exposure; a developing section B which develops a color negative film 4 exposed or a negative film 4 exposed for detection of processing performance by conveying it through a developing tank 8, a bleaching tank 10, a fixing tank 12, a washing tank 14 and a drying section 16 in the stated order; and an image reading device C for reading image data such as the transmission density of the reference pattern.

With the developing unit 2, two films 4 can be conveyed and immersed in processing solutions concurrently in a parallel mode. The image reading device C reads data on the image which is developed on the film 4, and utilizes the data thus read (hereinafter referred to as "image data", when applicable), to calculate a printing time or correct printing conditions. Operations taken according to the reference pattern and the image data will be described later with reference to FIG. 3 and subsequent.

The film 4, from which the image data have been read, is delivered to the printing unit 34 shown in FIG. 2, where a color photographic paper 36 is exposed through the film. The film 4 thus used is cut into pieces each including several frames (hereinafter referred to as "film pieces", when applicable). The film pieces are accommodated in a film sheet.

The printing unit 34 comprises: a color photographic paper exposing section a which exposes a color photographic paper 36 through the film 4 developed; an image forming section (developing section) b which, conveying the color photographic paper thus exposed through a developing tank 40, a bleach-fixing tank 42, a washing tank 44, and a drying section 46 in the stated order, processes it suitably thereby to form the image on the color photographic paper; and an image reading device c for reading data on the image on the color photographic paper 36 (hereinafter referred to as "image data", when applicable).

The exposing section a may be so designed that the color photographic paper 36 is exposed, in an analog mode, to light passed through the film 4, or it is exposed, in a digital mode, to a laser beam which is modulated according to the image data read from the film. It should be noted that the exposing section a is able to perform exposure both for the reference pattern and for ordinary images.

In the printing unit 34, the color photographic paper 36, on which latent images have been formed, is subjected to development bleach fixing, washing, and drying. The paper 36 thus processed is cut with a cutter 52 into pieces each including an image. Those pieces are delivered to a sorter 53 so that they are collected as one group.

Now, examples of the reference pattern for practicing a processing-performance detecting method according to the invention will be described with reference to FIGS. 3 and 4.

Figure 3:
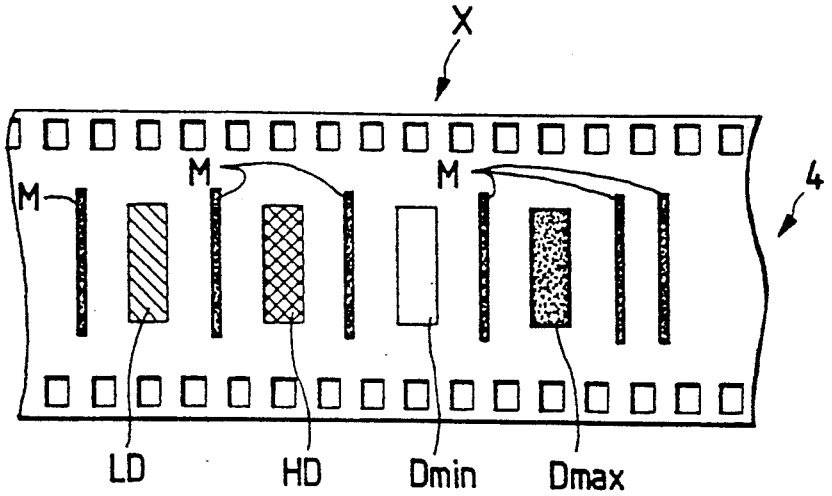
FIG. 3 is a diagram showing a reference pattern provided for detecting how a photographic film developing operation is performed.

FIG. 3 shows a reference pattern X which is formed on the film 4 by exposure at the reference pattern forming section A (FIG. 1). The reference pattern X includes four patterns LD, HD, $D_{min}$ and $D_{max}$ different in transmittance, and positioning marks M. The patterns LD and HD are to detect sensitivity; that is, contrast is detected from (HD−LD). The pattern $D_{min}$ is to detect stain, and the pattern $D_{max}$ is to detect solubility. The positioning marks M are used for timing control in detection of the processing performance.

Figure 4:
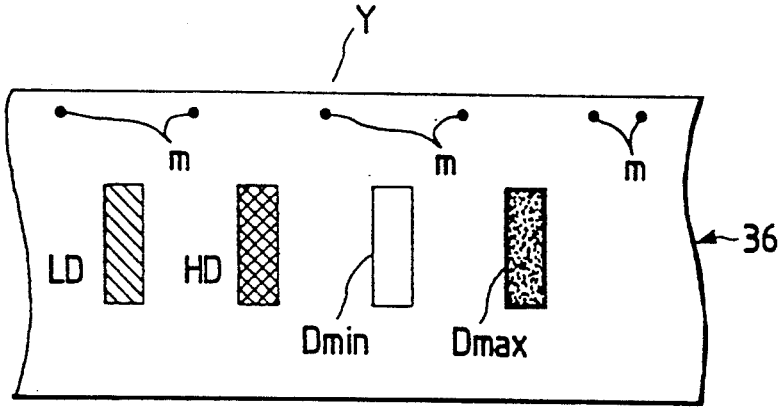
FIG. 4 is a diagram showing a reference pattern provided for detecting how a photographic paper developing operation is performed.

FIG. 4 shows a reference pattern Y which is formed on the color photographic paper 36 at the exposing section a (FIG. 2). Similarly as in the above-described reference pattern X, the reference pattern Y includes contrast detecting patterns LD and HD, a stain detecting pattern $D_{min}$, and a solubility detecting pattern $D_{max}$, and positioning marks m which are holes.

The reference pattern X or Y may be formed by bonding a plurality of ND filters on a lith (lithographic) film in which a void region is provided for the pattern.

Figure 5:
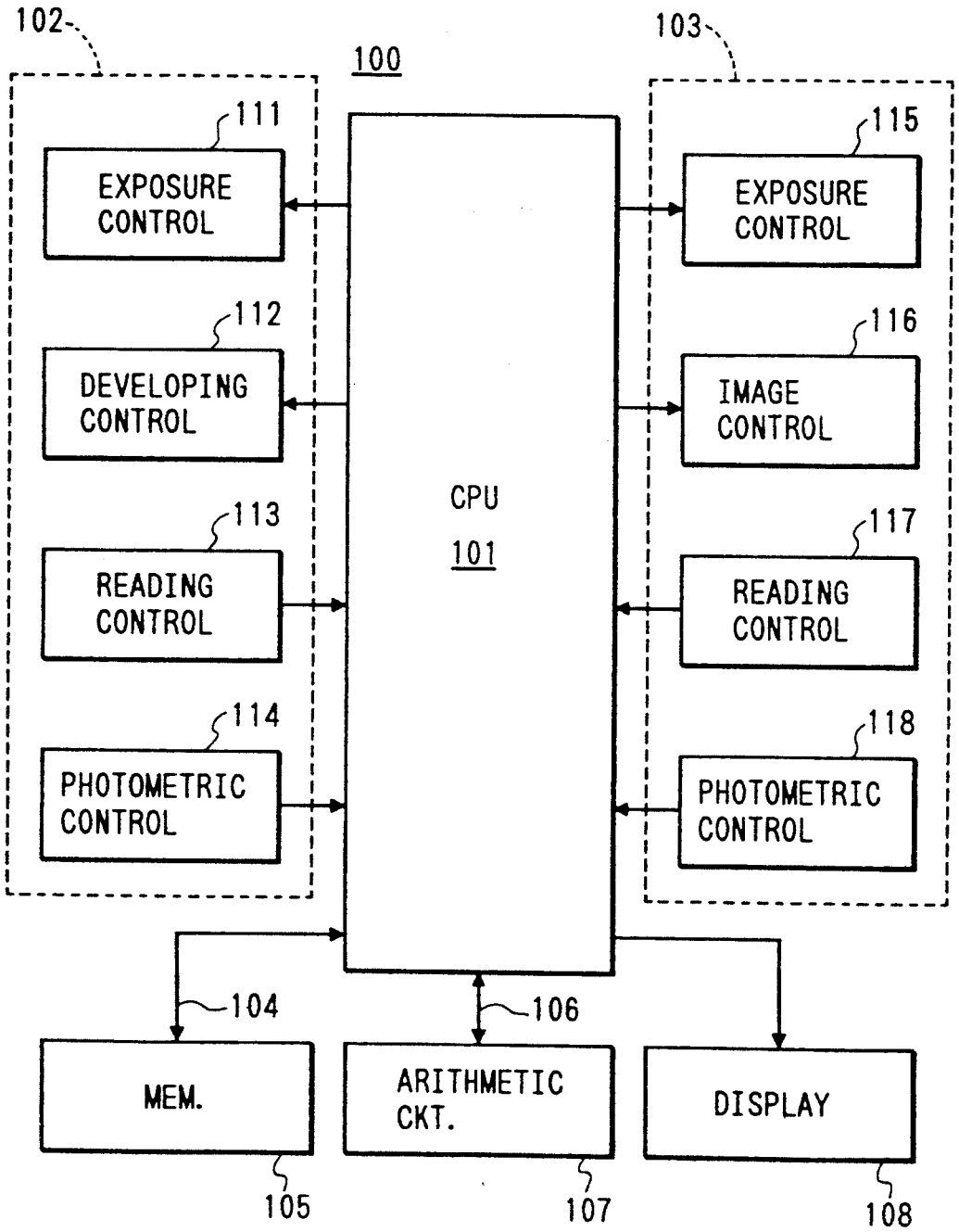
FIG. 5 is a block diagram showing the arrangement of a circuit for detecting operating conditions of an automatic developing and printing apparatus.

Now, the arrangement of a control device for practicing the processing-performance detecting method will be described with reference to FIG. 5.

The control device 100 is provided for operations of developing an ordinary photographic film, and making a print from a developed film, and for a processing-performance detecting operation. Roughly stated, the control device 100 comprises: a control section 101 made up of a CPU; a negative film control section 102 for mainly performing a developing operating and a processing-performance detecting operation in an ordinary mode with respect to the film developing operation described with reference to in FIG. 1; and a print control section 103 for mainly performing a developing operation and a processing-performance detecting operation in an ordinary mode with respect to the printing operation described with reference to FIG. 2.

The control section 101 is connected through a data bus 104 to a memory circuit 105, in which data for performing the developing and printing operations in an ordinary mode, and data for the processing-performance detecting operation have been stored in such a manner that they can be written in and read from it.

The control section 101 is further connected through a data bus 106 to an arithmetic circuit 107, so that predetermined arithmetic operations are carried out by using data read from the memory circuit 105 and data supplied from the negative film control section 102 and the print control section 103.

Now, the arrangement of the negative film control section 102 will be described.

The control section 102 comprises: an exposure control section 111 for performing control for the reference pattern exposing section A shown in FIG. 1; a developing control section 112 for performing control for the developing section B shown in FIG. 1; and a reading control section 113 for performing control for the image reading device C. When necessary, the control section 102 is provided with a photometric control section 114 for measuring the quantities of light emitted from light sources provided in the reference pattern forming section A and the image reading device C.

The print control section 103 comprises: an exposure control section 115 for performing control for the photographic paper exposing section a; an image control section 116 for performing control for the image forming section b; a reading control section 117 for performing control for the image reading device c; and a photometric control section 118 for measuring the quantities of light emitted from light sources provided in the print exposing section a and the image reading device c.

The processing-performance detecting method according to the invention will be described with reference suitably to FIGS. 1 through 5.

First, a negative film 4, which has been not yet exposed, is set at the inlet of the developing unit 2. The inlet is located above the reference pattern forming section A. The reference pattern X shown in FIG. 3 is set on a diffusion box 120 forming the reference pattern forming section A. Under this condition, the film 4 is exposed through the reference pattern X to light emitted from a light source 121 in the reference pattern forming section A, so that the latent images of the patterns LD, HD, $D_{min}$ and $D_{max}$, and the positioning marks M are formed on the film 4. In FIG. 1, reference numeral 122 and 123 designate a condenser lens and a shutter, respectively.

The negative film 4 thus processed is conveyed to the developing section B. At the developing section B, the film 4 is developed in the above-described manner; that is, the reference pattern X is developed on the film 4. The film 4 thus processed is conveyed to the image reading device C.

The above-described operations of exposing, conveying and developing of the negative film 4 are automatically carried out by the control device 100 described with reference to FIG. 5.

The image reading device C reads the transmission densities and contrasts of the patterns LD, HD, $D_{min}$ and $D_{max}$. The data thus read are applied to the control section 101. The control section 101 supplies the data and the previous data stored in the memory circuit 105 to the arithmetic circuit 107, where they are subjected to comparison, for detection of changes in developing performance. The changes thus detected are referred to a decision table described later, so that various set values are automatically corrected, and the results of correction are displayed on a display circuit 108.

Historical data, such as changes in transmission density, automatic correction, and results of actions taken are stored in the memory circuit 105. Those data are read out of it for confirmation when necessary.

The negative film 4, on which the reference pattern X has been formed, is automatically conveyed to the printing unit 34 shown in FIG. 2.

The operating conditions of the printing unit 34 are detected as follows:

A color photographic paper 36 is set in the upper portion of the photographic paper exposing section a, and the aforementioned reference pattern is set on a negative film carrier 131 positioned above the diffusion box 130. Under this condition, the latent image of the reference patter X is formed on the color photographic paper 34 with light emitted from a light source 132. In FIG. 2, reference numeral 133 designates a condenser lens; and 134, a shutter. The photometric control section 118 measures the quantity of light to be applied to the control section 101. The control section 101 operates to control the quantity of light of the light source 132, and refer to the data thus measured in detection of the densities.

After the latent image of the reference pattern X has been formed on the color photographic paper 36 at the photographic paper exposing section a, the photographic paper 36 is punched to form the above-described positioning marks m for indication of a measurement position. The color photographic paper 36 thus processed is delivered to the developing section b.

In the developing section b, the developing operation is carried out for the photographic paper 36 as was described with reference to FIG. 2. Thereafter, the color photographic paper 36 is delivered to the image reading device c. In the image reading device c, the reflection densities of the patterns LD, HD, $D_{min}$ and $D_{max}$ are measured with reference to the positioning marks m. In this operation, the arrangement of a light source providing reflection light is intentionally omitted but it is made similarly as in the case of the photographic paper exposing section.

Measurement data such as the reflection densities are supplied to the control section 101, where they are compared with the reference data stored in the memory circuit 105. The changes of the measurement data are compared with the decision table, so that various set values are automatically corrected, and necessary actions are displayed.

Historical data, such as changes in transmission density, automatic correction, and results of actions taken are stored in the memory circuit 105, so that they can be confirmed when necessary.

Since the reference pattern X developed on the negative film 4 by the film developing device 2 is employed for the printing unit 34, the total performance of the film developing unit 2 and the printing unit 34 can be determined. For instance even when a function of the film developing unit 2 is lowered, sometimes it is unnecessary to correct the function if the printing unit 34 outputs a satisfactory print.

The processing-performance detecting operation can be performed for the automatic developing and printing apparatus at any time. However, the operation should be made particularly in the following cases:

Installation Adjustment: This is performed mainly by a service man skilled in the art when the automatic developing and printing apparatus is installed. For instance, reference values are stored for absolute measurement and automatic relative measurement of the performance.

Daily Maintenance: This is performed mainly by the user. Automatic relative measurement, and automatic decision are carried out. When necessary, automatic correction, and cleaning are carried out.

Periodic Maintenance: This is performed mainly by the service man. Absolute measurement of the performance, and cleaning are carried out. When necessary, the mother liquor is replaced.

Repair: This is carried out mainly by the service man. When, in the daily maintenance, it is determined through automatic decision that the apparatus involves a failure or is out of order for unknown reason, the service man is dispatched to repair the apparatus.

In the installation adjustment, or in the periodic maintenance, after injection of the mother liquor and the supplement liquor, the amount of supplement liquor, and data such as temperature which can be measured are checked. In addition, the density measurement is performed by using the control strips, to determine the absolute level of the developing performance. Furthermore, the automatic measurement sequence is performed (i.e., the reference pattern is formed on a photosensitive material by exposure which is not exposed yet, and the photosensitive material thus processed is developed, for automatic density measurement), so as to store the density data which are provided when the apparatus is in normal state.

Figure 6:
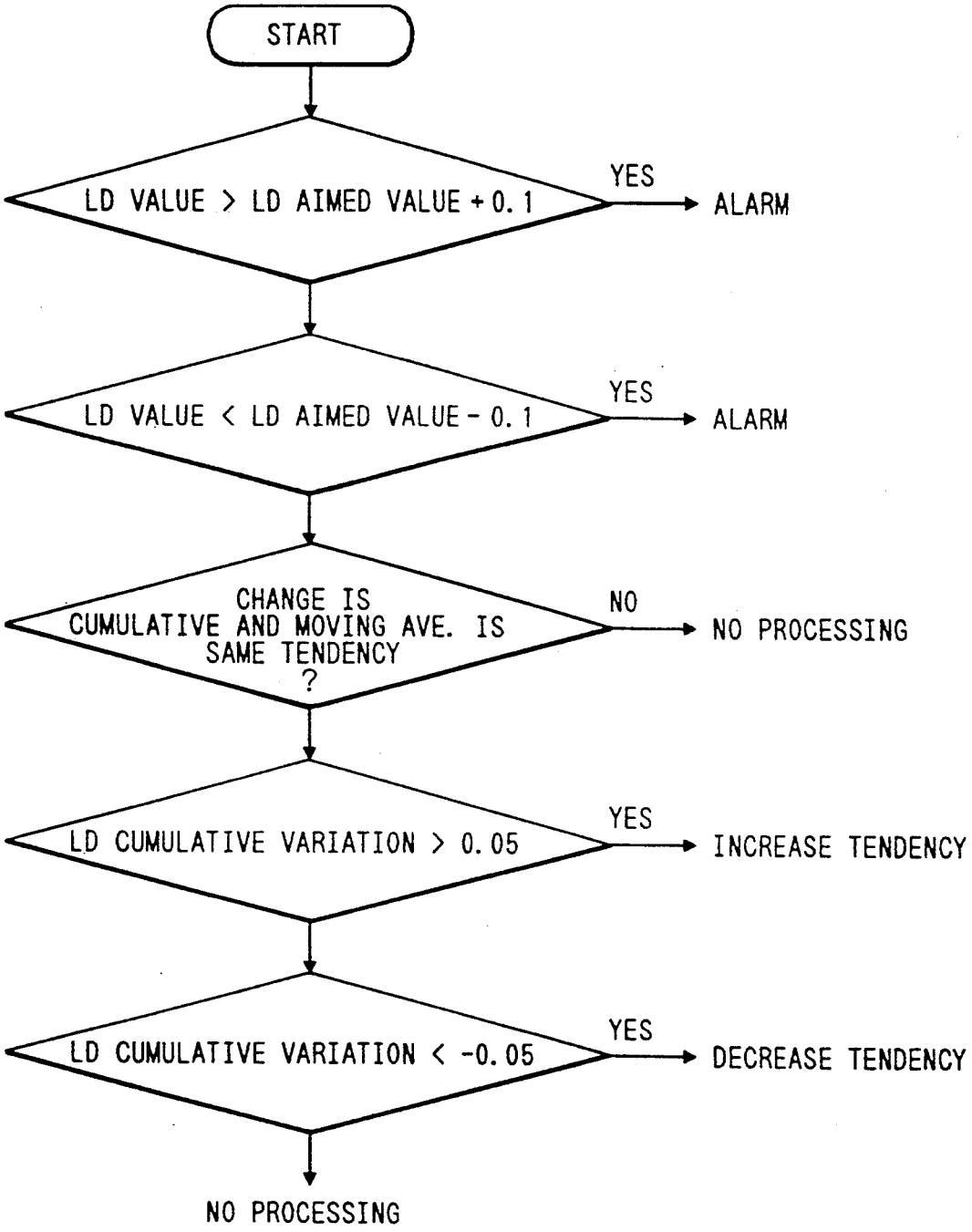
FIG. 6 is a flow chart showing an example of a control sequence for determining variation patterns.

In the daily maintenance, the automatic measurement sequence, an example of which is shown in FIG. 6 is carried out every day. Measurement data provided by the automatic measurement sequence are compared with those which have been stored at the installation of the apparatus. The results of comparison are utilized to form a table which is to be compared with the decision table described later. When the results of comparison are normal, only a data storing operation (storage of historical data) is carried out. When the results of comparison are determined abnormal, the following actions are taken: That is, when it is determined that some action can be taken to correct the abnormal condition, the correcting action is automatically carried out. The correcting action is, for instance, change of the amount of supplement liquor, or supplement of the quantity of water which is reduced by evaporation. If the abnormal condition cannot be automatically corrected, a warning signal is displayed on the display section so as to cause the user to take a necessary action or to call the service man. In this case, for instance, cleaning of the filter which is clogged up, and replacement of the mother liquor are carried out. The decision table is formed according to the artificial intelligence theory for every recipe and for every photosensitive material. A decision is made by using the relative values of density variations, and the cumulative characteristics of the same.

In repairing the apparatus, the results of decision as to the automatic measurement and the historical data are referred to for determination of the possible range in which the failure occurs, so that the apparatus is repaired with high efficiency.

An example of the decision table is as shown below:

TABLE 1

| | (MEASUREMENT VALUE-REFERENCE VALUE) CHANGE PATTERN | | | |
|---|---|---|---|---|
| | LD | HD-LD | $D_{min}$ | $D_{max}$ |
| (1) | Increased | Unchanged | Unchanged | Increased |
| (2) | Decreased | Increased | Unchanged | Unchanged |

When the change pattern is as indicated by (1) in Table 1, and the change is cumulative, then it is determined that the quantity of supplement to the developing solution is large, and the quantity of supplement is automatically adjusted (or decreased) to an allowable range which is described hereinafter with reference to FIG. 6.

When the change pattern is as indicated by (2) in Table 1, and the change is cumulative, then it is determined that the quantity of supplement to the developing solution is small, and the quantity of supplement is automatically adjusted (or increased) to the allowable range.

Now, a sequence of decisions on change patterns; i.e., increase and decrease tendencies, will be described with reference to FIG. 6 concerning LD. However, it should be noted that decisions can be made for (HD−LD) and $D_{max}$ in the same manner. In this case, reference values for decisions are suitably determined. On the other hand, $D_{min}$ is generally unchanged, and therefore it is not subjected to decision.

As is seen from FIG. 6, in the case where the LD value is greatly different from the aimed value, it may be unnecessary to combine it with other values for decision. That is, an alarm may be given immediately. In the case of FIG. 6, the reference value is +0.1 or −0.1 of the aimed value. When it is unnecessary to raise an alarm for the LD value; that is, when the LD value is in a predetermined range of allowance, a moving average of the measured LD values which is an average of at least three measured LD values is obtained plural times. When a change tendency of the moving averages thus obtained is not the same at least three times, it is determined that the developing condition is stable. Next, the cumulative variation thereof is measured at intervals of a predetermined period of time, for instance, one day through three days. When the cumulative variation thus measured is more than +0.05 or less than −0.05, it is determined that the LD value is in an increase tendency or in a decrease tendency, respectively. By way of example, in the case of (HD−LD), the reference value for the cumulative variation is ±0.05; and in the case of $D_{max}$, it is 0.05. When the cumulative variation is within the reference value, it is determined that the density is stable, and therefore the operation is continued as it is. Similarly as in the above-described case, the tendency of variation of each of the density values is detected so that a change pattern is determined; that is, case (1) or case (2) is determined, for control of the quantity of supplement to the developing solution. In general, the density can be corrected by adjustment of ±5%.

If, in the measurement, infrared (IR) ray is employed in addition to red (R), green (G) and blue (B) light, then it can be determined whether or not delivering is satisfactory. As for the accuracy of exposure in formation of the reference pattern, it is desirable to employ an algorithm that, even if the absolute value of the quantity of light is somewhat erroneous, a decision is made as long as the relative value thereof is stable, because security of the absolute value of the quantity of light will result in an increase in the manufacturing cost of the apparatus. Furthermore, in order to suitably deal with the changes which may be involved when the emulsion number of the photosensitive material not exposed is changed, it is desirable to store the difference between the emulsion numbers.

A concrete example of the present invention will be described.

A color negative film HG-100 manufactured by Fuji Photo Film Co., Ltd is employed as a photosensitive material, and after exposing the color negative film, the film is subjected to developing process by using an automatic processor as follows. The developing process is continuously carried out until an accumulated quantity of a replenisher becomes 100 liters.

| Process Steps | Process Period (Sec.) | Process Temp. (°C.) | Quantity of Replenisher (ml) | Tank Capacity (l) |
|---|---|---|---|---|
| Color Development | 195 | 37.8 | 16 | 10 |
| Bleaching | 30 | 38.0 | 5 | 5 |
| Fixing | 60 | 38.0 | 15 | 10 |
| Washing (1) | 20 | 38.0 | — | 5 |
| Washing (2) | 20 | 38.0 | 20 | 5 |
| Stabilizing | 20 | 38.0 | 20 | 5 |
| Drying | 60 | 55.0 | — | — |

Note: The above quantity of a replenisher is an amount necessary for processing of a 35 mm width negative film of 1 meter and the washing is carried out by making a washing solution flow from (2) to (1).

Examples of the color developer, bleaching solution, fixing solution, washing solution and stabilizing solution are well known in the art. For example, they are disclosed as Example 5 in Published Unexamined Japanese Patent Application No. Hei-2-250052.

In an experiment, an allowable operation range of the respective LD, (HD−LD), and $D_{min}$ is defined by (Reference value ±0.03), and when a measured value exceeds the upper range, the quantity of a replenisher decreases from 16 ml to 15 ml. Then, after the negative film of 10 m is processed, the measurement is carried out, as a result of which the measured value becomes (0.02+the reference value). Further, after the processing of the negative film of 35 m, the measured value is made equal to the reference value. In other words, the normal condition is obtained after the processing of the negative film of 45 m. Thereafter, the quantity of the replenisher is increased to the initial set value of 16 m;. In this case, the range is determined by values of 60 to 80% of a threshold value ±0.05 in order to restore the performance of the respective processing solution before the performance thereof exceeds the threshold values.

In the invention, the photosensitive material is employed on which the pattern having portions different in the quantity of light has been formed by exposure and by development. This photosensitive material functions in the same way the photographic material having the control strips. Hence, the processing performance of the apparatus can be determined without use of the photographic material having the control strips which is expensive and troublesome to handle.

According to the invention, the reference pattern forming section and the image reading section are provided in both of the developing unit and the printing unit which forms the automatic developing and printing apparatus. In the developing step and in the printing step, image density data are detected, and the image density data thus detected are compared with the reference image density data which have been stored, thereby to detect the conditions of the photographic film developing performance and the photographic paper developing performance, and control is made for automatic correction of the performance, or necessary actions to be taken are displayed. Therefore, the performance of the apparatus can be correctly maintained even by a person who is not skilled in the art.

When a plurality of operating conditions are changed, it can be readily detected whether or not the changes of those conditions act to cancel the effects thereof. In the case where the changes of the operating conditions act to cancel the effects thereof, the frequency of troublesome maintenance operations such as replacement of the mother liquor can be reduced to a smallest value.

What is claimed is:

1. An apparatus for maintaining processing performance in an automatic developing and printing system comprising:

means for developing, under a predetermined condition, a reference negative film having at least three densities which respectively give a maximum density ($D_{max}$), a high density (HD), and a low density (LD) to a positive photosensitive material, so as to measure the densities of said positive photosensitive material thus developed;

means for obtaining a moving average of each of $D_{max}$, (HD−LD) and LD from the values $D_{max}$, HD and LD thus measured to obtain cumulative values thereof;

means for deciding that, when an amount of shift of each cumulative value from a reference value is equal to or more than a predetermined value, said value is in an increase tendency or in a decrease tendency;

means for identifying patterns which are combinations of results of decision of said cumulative values; and means for controlling a quantity of supplement to a developing solution according to the identification.

2. The apparatus as defined in claim 1 wherein said deciding means decides that when the amount of shift of the cumulative value LD from a reference value is larger than 0.05, the value LD is in an increase tendency whereas said deciding means decides that when the amount of shift of the cumulative value LD therefrom is less than −0.05, the value LD is in a decrease tendency.

3. The apparatus as defined in claim 1 wherein said deciding means decides that when the amount of shift of the cumulative value (HD−LD) from a reference value is larger than 0.05, the value (HD−LD) is in an increase tendency whereas said deciding means decides that when the amount of shift of the cumulative value (HD−LD) therefrom is less than −0.05, the value (HD−LD) is in a decrease tendency.

4. The apparatus as defined in claim 1 wherein said deciding means decides that when the amount of shift of the cumulative value $D_{max}$ from a reference value is larger than 0.05, the value $D_{max}$ is in an increase tendency.

5. The apparatus as defined in claim 1 wherein said controlling means decreases a quantity of supplement to a developing solution when the values of LD and $D_{max}$ are in the increase tendency.

6. The apparatus as defined in claim 1 wherein said controlling means increases a quantity of supplement to a developing solution when the value of LD is in the decrease tendency and the value of (HD−LD) is in the increase tendency.

7. A method of maintaining processing performance of a developing means for developing a photosensitive material, comprising the steps of:

exposing a pattern having portions different in the quantity of light on a photosensitive material;

developing the pattern on said photosensitive material;

measuring densities of the pattern thus formed;

comparing the densities thus measured with predetermined fixed-values to obtain a variation pattern therefrom, comparing the variation pattern with predetermined reference variation patterns to determine the condition of developing performance of said developing means; and taking a suitable action automatically to maintain the developing performance of said developing means.

* * * * *